United States Patent [19]

Larson

[11] 4,325,239

[45] Apr. 20, 1982

[54] KEY SAFE HAVING IMPROVED BAR LOCKING SYSTEM

[75] Inventor: Wayne F. Larson, Salem, Oreg.

[73] Assignee: Supra Products, Inc., Salem, Oreg.

[21] Appl. No.: 112,867

[22] Filed: Jan. 17, 1980

[51] Int. Cl.[3] ..... E05B 65/06; E05C 3/02

[52] U.S. Cl. ..... 70/139; 292/194; 292/202

[58] Field of Search ..... 70/139, 123, 86, 81; 292/194, 202, 340, 218

[56] References Cited

U.S. PATENT DOCUMENTS

| | | | |
|---|---|---|---|
| 1,546,671 | 7/1925 | Panning | 292/202 |
| 2,255,402 | 9/1941 | Vile | 70/139 |
| 3,084,532 | 4/1963 | Williams | 70/63 |
| 3,236,075 | 2/1966 | Williams | 70/63 |
| 3,237,436 | 3/1966 | Williams | 70/363 |
| 3,436,937 | 4/1969 | Barrett | 70/63 |
| 3,800,576 | 4/1974 | Barrett et al. | 70/302 |

FOREIGN PATENT DOCUMENTS

| | | | |
|---|---|---|---|
| 831814 | 2/1952 | Fed. Rep. of Germany | 292/202 |
| 2405 | of 1906 | United Kingdom | 70/139 |

*Primary Examiner*—William E. Lyddane
*Attorney, Agent, or Firm*—Klarquist, Sparkman, Campbell, Leigh, Whinston & Dellett

[57] ABSTRACT

A safe having a base plate to be covered by a hingedly mounted hood which can be locked in place by a lock carried by the hood, wherein the locking element carried by the hood not only fits under a retainer element on the base plate but also fits in a slot in the hood.

8 Claims, 9 Drawing Figures

KEY SAFE HAVING IMPROVED BAR LOCKING SYSTEM

BACKGROUND OF THE INVENTION

In prior key safes of the type under consideration, the locking arm fits under a retainer on the base plate. When a prying force is applied to the hood, a severe bending force is imposed on the connection between the arm and the locking barrel, allowing unlawful entry unless the connection is made quite strong indeed.

SUMMARY OF THE INVENTION

The present invention overcomes the above difficulty by providing a slot or groove in the hood to receive the outer end of the locking arm, and by providing a boss on the base plate in close proximity to the connected end of the arm, when the hood is closed, so that a substantial portion of the prying forces on the hood would be taken by the arm in bending rather than by the arm connection.

PREFERRED EMBODIMENT OF THE INVENTION

Figure 1:
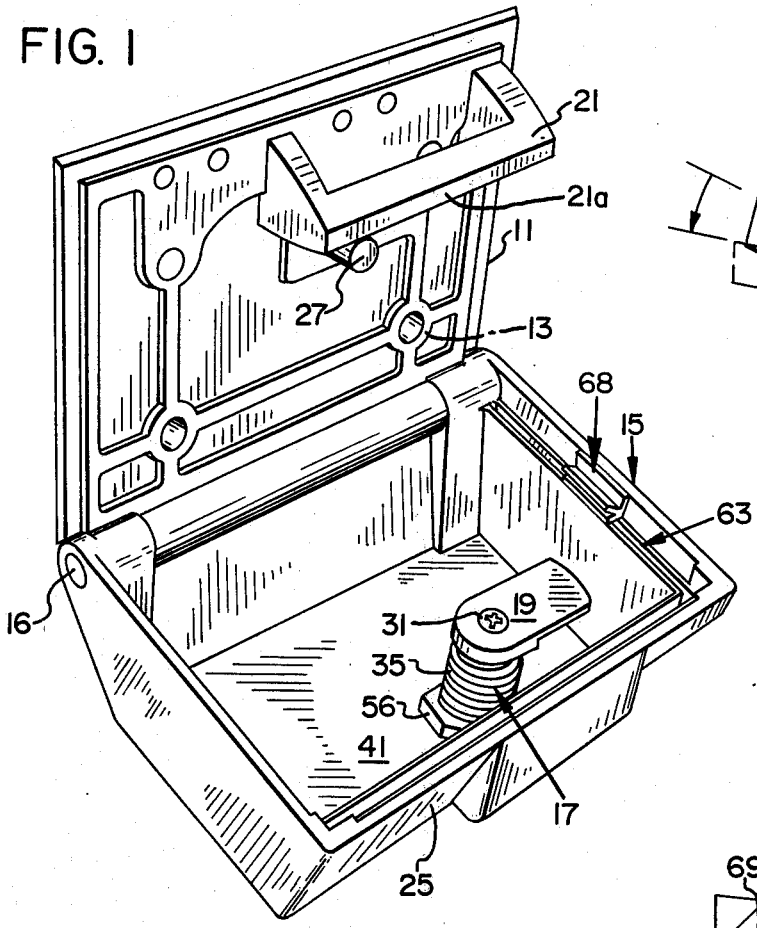
FIG. 1 is a perspective view of the key safe with the hood swung to an open position.
Figure 4:
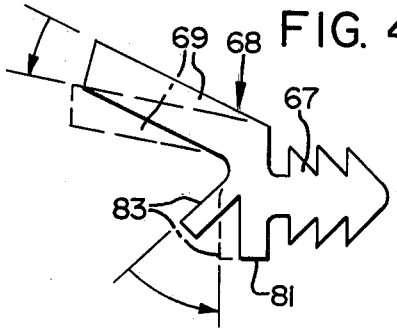
FIG. 4 is an isolated view of the cross section of the seal between the hood and the base plate.

In the particular form of the invention shown, the device includes a base plate 11 secured by screws 13 to a wall or other structure. A hood 15 is hingedly mounted at 16 to the base plate and may be securely locked in a closed position on the base plate by a lock generally indicated at 17. The locking element of the lock 17 is in the form of an arm 19 which extends laterally from the axis A of the lock and can be turned to and from a position projecting through a bail like retaining member 21 fixed to or integral with the base plate.

When the arm is in its locking position projecting through the retaining member, its free end portion fits in a locking groove 23 formed in one of the side walls 25 of the hood 15. The opposite end portion of the arm is disposed closely adjacent a boss 27 on the base plate 11, when the hood is closed.

Figure 2:
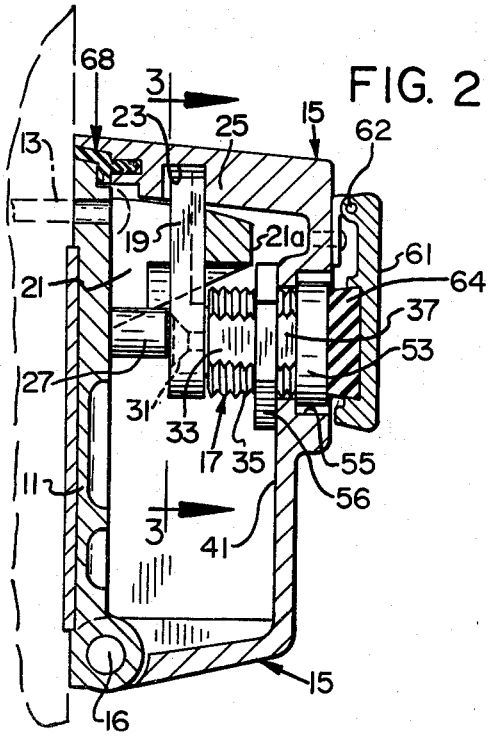
FIG. 2 is a vertical sectional view through the safe with the hood in its closed position.
Figure 3:
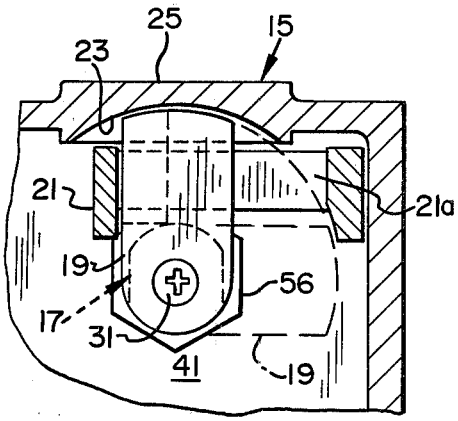
FIG. 3 is a fragmentary vertical sectional view taken along line 3—3 of FIG. 2.

The arm 19 is secured by a screw 31 to a barrel or core 33 (FIG. 2) of the lock. The arm has a nonrotatable end spline fit with the barrel, the barrel being turnably mounted in a threaded housing 35. The latter has flats 37 to make the housing non-circular in cross section, to enable it to fit in nonrotatable fashion through a non-circular hole in the front wall portion 41 of the hood 15. The housing 35 has a flange 53 seated in a recess 55 formed in wall 41. A nut 56 threads on the housing up against the inner face of the wall 41 to fixedly mount the housing on such wall.

The outer face of barrel 33 is exposed at the front of the lock. The arm 19 may be turned by turning a key (not shown) which is inserted in a key slot exposed in the front face of the barrel. A spring or gravity biased rain cap 61 is pivotally mounted at 62 on the hood 15 and has an elastomer pad 64 normally covering the key opening, thus to protect the internal parts of the lock from the weather.

Figure 5:
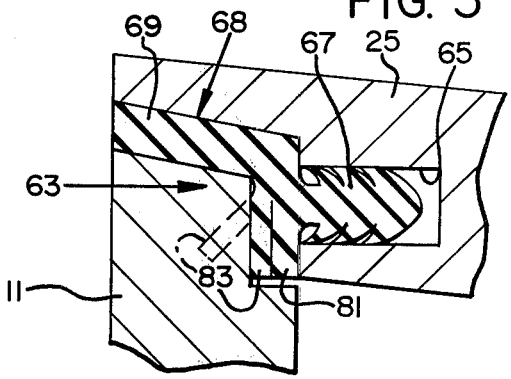
FIG. 5 is an enlarged fragmentary sectional view through the seal between the hood and the base plate.

The hood has a slotted edge portion 63 which is substantially coextensive with the side and top walls of the hood. Portion 63 has a deep slot 65 to receive and retain a foot portion 67 of an elastomer seal 68. The latter has a side flange 69 to fit between the hood and the top and side edges of the hood, and the top and side edges of the base plate. The seal also has two other flanges 81 and 83 (FIG. 5). Flange 81 extends in a direction parallel to the plane of the base plate, whereas flange 83, when undistorted, is obliquely disposed relative to said plate. When the hood is closed, the closing action depresses the flange 83 against the flange 81 to form a good weather seal.

The bottom edge of the hood and of the base plate, at the hinge 16, is unsealed, sealing at this point being unnecessary. In fact, a narrow opening is desirable, in case moisture happens inadvertently to gain entrance to the lock, to enable the moisture to drain out.

Figure 6:
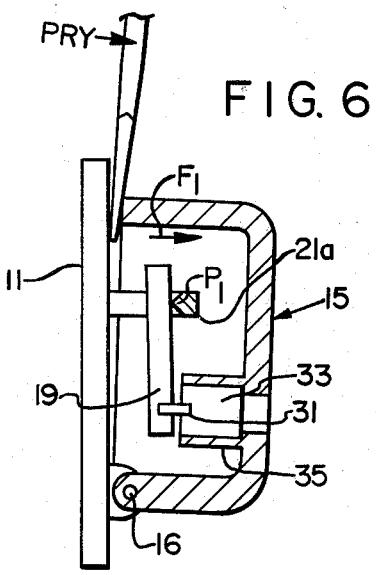
FIG. 6 is a diagrammatic force diagram of the forces on the system, without the improvements of the present invention.
Figure 7:
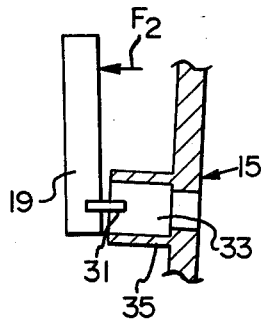
FIG. 7 is a simplified version of FIG. 6.

FIG. 6 shows a force diagram of a safe not having the groove 23 and the boss of the present invention. Assume that a prying force, labeled PRY, is exerted on the hood 15. This translates into an upward force $F_1$ on the hood about the pivot or hinge 16. The outer portion of the arm 19 cannot move upwardly because of the bridging portion 21*a* of the retainer 21. This means that a substantial bending force is imposed on the connection 31 (screw) between the arm 19 and the barrel 33 within the housing 35. Eliminating unnecessary parts, FIG. 7 shows the resultant system with the arm 19 being supported in cantilever fashion by the connection 31, with a downward force $F_2$ trying to pry the arm 19 away from the barrel and housing, and thus putting substantial bending forces on the connection.

Figure 8:
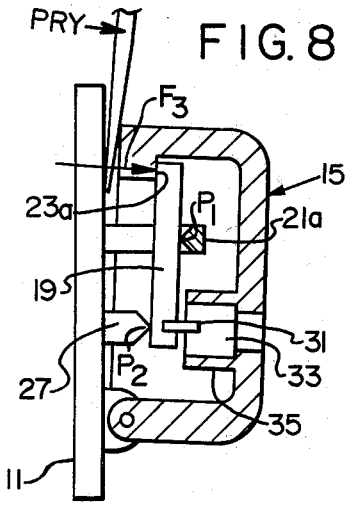
FIG. 8 is a force diagram of the system with the improvements of the present invention.
Figure 9:
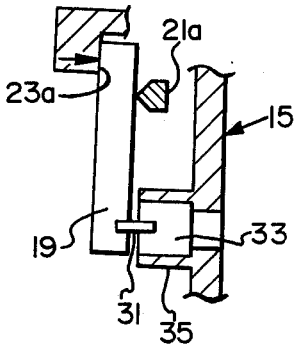
FIG. 9 is a force diagram similar to FIG. 7 but relating to the present invention.

FIG. 8 shows a force diagram with the improvements of the present invention. Now, there is an entirely different result. There is an upward force $F_3$ applied by the shoulder 23*a* on the left hand end of the arm 19, attempting to move the left hand end outwardly. There is a fulcrum provided by the bridging portion 21*a*, and the boss 27 provides a second fulcrum $P_2$. With this arrangement, the serious bending force formerly imposed on the connection 31 is eliminated and translated into bending forces on the arm 19 (which is quite a strong member as compared to the strength of the connection 31).

Ideally, 100% of the prying forces on the hood would be imposed on the arm. However, it is realized that any outward movement of the hood so as to create the force $F_3$, will simultaneously pull outwardly on the connection at 31. However, the stress at 31 is in tension and only a small fraction of the force on 31 in FIG. 6. Thus, a substantial reduction of the forces on connection 31 is realized.

It is further pointed out that if the pivot $P_2$ (boss 27) in FIG. 8 were eliminated, an improvement over FIG. 6 would nevertheless be realized, because the force $F_3$ (FIG. 8) acts through a short lever arm regarding fulcrum 21*a*, while the connection acts through a long lever arm. This would diminish the proportion of the force $F_3$ imposed on connection 31.

In another form of the invention, the arm 19 is mounted on the barrel of the lock by a connection which permits no play circumferentially but provides for a looseness or slop axially. Thus, when a prying force is applied to the hood and the hood lifts the arm 19 slightly, there is also a slight upward movement at the connection 31. However, because of the lost motion connection at 31, the latter accommodates such movement without stressing the connection. Thus the arm solidly engages the boss 27 and assumes 100% of the stresses, which in FIG. 2 would be borne to a minor extent by the connection 31.

The lost motion connection at 31 can be readily provided by forming the screw 31 with a shoulder abutting against the barrel, with screw head and shank fitting in an oversize hole in the arm. Also, the fit of the splines on the barrel end would have a sufficiently sloppy fit in the spline grooves to permit a slight movement of the arm relative to the barrel without separating the splines and grooves.

Or, the barrel 33 could have a sufficiently sloppy endwise fit in its housing 35 as to permit the desired movement of the connection 31.

What is claimed is:

1. In a lock device, a first member and a second member to be locked together, a lock including an arm on one member movable to and from a locking position with respect to a retaining means on the other member, and means for establishing a connection between said arm and said one member at opposite sides of said retaining means when said arm is in its locking position.

2. A lock device as set forth in claim 1, wherein the arm is mounted at one end in cantilever fashion on said one member.

3. A lock device as set forth in claim 2, wherein said other member carries an abutting portion disposed in back-up contiguous relation to said one end of said arm in the locking position thereof.

4. A lock device as set forth in claim 3, wherein said arm at said one end has a lost motion connection with said one member.

5. A lock device as set forth in claim 1 wherein said one member is of hood shape and said other member is a base member, said one member carrying a locking mechanism for actuating said arm and being exposed at the exterior of said one member.

6. A lock device as set forth in claim 5 wherein said means includes a connection at one end of said arm connecting it to said locking mechanism, and said arm extends in cantilever fashion from said connection, said means retainingly engaging the other end of said arm in the locking position of said arm.

7. A lock device as set forth in claim 6 wherein said other member carries an abutting portion disposed in back-up contiguous relation to said one end of said arm in the locking position thereof.

8. A key safe comprising:

a hood member, a base member, means hingedly mounting said base member at one edge of said hood member for movement to and from a position closing the open side of said hood member, a bail-like retaining member on said base member, locking means on said hood including an arm mounted at one end for pivoting movement to and from a position projecting through said bail member in spaced relation from the pivotal axis, said arm when in its locking position having an end portion extending beyond said bail-like retaining member, and means on said hood for receiving the said end portion to preclude movement thereof in the direction of separating movement of said hood member and said base member.

* * * * *